US005202003A

United States Patent [19]

Gordon

[11] Patent Number: 5,202,003

[45] Date of Patent: Apr. 13, 1993

[54] ELECTROLYTIC REMOVAL OF TIN OXIDE OR TITANIUM NITRIDE FROM A COATER

[76] Inventor: Roy G. Gordon, 22 Highland St., Cambridge, Mass. 02138

[21] Appl. No.: 830,773

[22] Filed: Feb. 3, 1992

Related U.S. Application Data

[62] Division of Ser. No. 484,129, Feb. 23, 1990.

[51] Int. Cl.[5] ..... C25F 1/00; C25F 5/00

[52] U.S. Cl. ..... 204/146

[58] Field of Search ..... 204/141.5, 146

[56] References Cited

FOREIGN PATENT DOCUMENTS 186899 8/1988 Japan .

*Primary Examiner*—T. M. Tufariello

*Attorney, Agent, or Firm*—Samuels, Gauthier & Stevens

[57] ABSTRACT

A method for the electrolytic removal of titanium nitride from a coater surface. The titanium nitride coater surface functions as an anode and another electrode functions as the cathode. The voltage applied across the electrodes removes the titanium nitride from the surface of the coater.

4 Claims, 1 Drawing Sheet

ELECTROLYTIC REMOVAL OF TIN OXIDE OR TITANIUM NITRIDE FROM A COATER

This is a divisional of co-pending application Ser. No. 07/484,129 filed on Feb. 23, 1990.

BACKGROUND OF THE INVENTION

Glass and other transparent materials can be coated with transparent semi-conductor films such as tin oxide in order to reflect infra-red radiation. Such materials are useful in providing windows with enhanced insulating value (lower heat transport) for use in architectural windows, etc.; see for example, RE 31,708. Coatings on glass of tin oxide in combination with other coatings, such as iridescence—suppression coatings, are now enjoying commercial acceptance.

Another important glass coating is titanium nitride, which has optical properties that make it very efficient in controlling undesired solar heat gain through windows of buildings in warm climates.

When a glass surface is coated with tin oxide, a coater deposits the tin oxide on a moving glass surface. Ideally, it would be desirable to control the fluid flow characteristics of the reactants which form the tin oxide and the spatial relationship between the coater surface overlying the moving glass surface, such that the tin oxide which is formed, would only deposit on the moving glass surface. As a practical matter this has not been possible to achieve with the result that the tin oxide also coats the coater surface overlying the glass surface on which the tin oxide is deposited. When the tin oxide is formed by reaction of stannic chloride vapor with water vapor, a hard glossy deposit of tin oxide forms on the coater surface, which can be made of graphite or other corrosion-resistant materials such as nickel-based metal alloys (e.g. Inconel (trademark of Huntington Alloys, Inc.) or Hastelloy (trademark of Haynes International, Inc.)).

A similar effect occurs when glass is coated with titanium nitride by the reaction of titanium tetrachloride with ammonia, according to U.S. Pat. No. 4,535,000. A hard layer of titanium nitride forms on the coater, as well as on the glass.

After a production run, the coater surface must be cleaned before it is used again. Generally the tin oxide is removed by scraping. This procedure suffers from certain disadvantages. The contour of the graphite or metal is distorted because it is softer than the tin oxide and areas free of tin oxide are scraped more than areas where the tin oxide is attached. Patches of adherent tin oxide remain on the surface and an uneven surface still results. A similar problem is found with the removal of titanium nitride from its coating apparatus.

It is known to use zinc powder and hydrochloric acid to etch tin oxide. However, this method is not convenient for thick layers of tin oxide, say ranging between 0.5 to 2.0 mm thick nor is it easily practiced over large areas, say for example 3 $m^2$. Similarly, titanium nitride cannot be dissolved in any solvents or acids. Titanium nitride does dissolve slowly in boiling mixtures of concentrated hydrochloric and nitric acid (aqua regia), but such a treatment of a large coater would be impractically dangerous to workers and destructive of the coater.

SUMMARY OF THE INVENTION

Briefly the invention comprises electrochemically removing a tin oxide or titanium nitride coating from a coater surface. This ensures that the coater surface is not injured because of the removal of the tin oxide or titanium nitride.

Broadly one embodiment of the invention comprises placing the tin oxide coated coater in an electrolytic bath to function as the cathode of a pair of cell electrodes. The tin oxide is electrolytically removed by either reducing the tin oxide to tin metal and then dissolving the tin, or by creating a bubble of hydrogen gas at the coater surface/tin oxide interface. The pressure of the hydrogen gas forces the tin oxide to break away from the coater at the coater surface/tin oxide interface. Either mechanism can occur, but preferably both mechanisms are used in combination.

The relative importance of the two removal mechanisms varies with such conditions as the electrolyte, voltage, current and temperature used.

In another embodiment of the invention, the titanium nitride coated coater surface is placed as the anode in an electrolytic cell. The titanium nitride is removed electrolytically by either being oxidized and dissolved, or by breaking off in flakes probably dislodged by bubbles of oxygen and/or other gases evolving at the coater surface.

DESCRIPTION OF THE PREFERRED EMBODIMENTS

Figure 1:
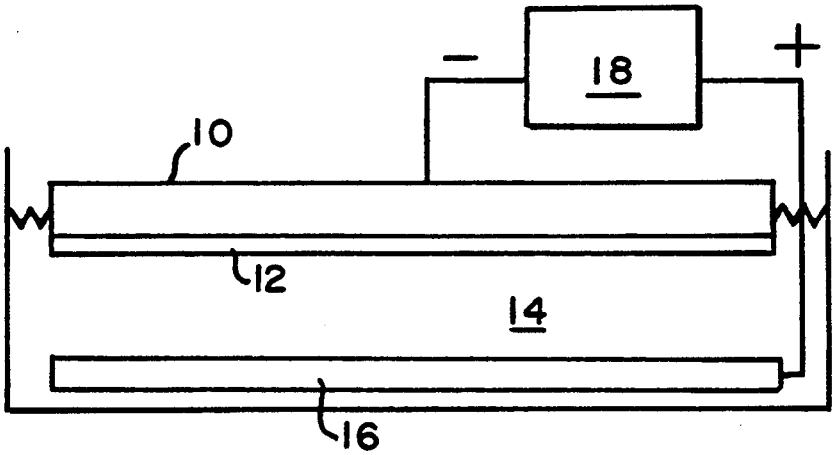
FIG. 1 illustrates an electrolytic cell used for the removal of tin oxide.

In FIG. 1, a graphite coater section 10 having a surface covered by a tin oxide layer 12 between 0.5 to 2.0 mm thick and about 3 $m^2$ in area is placed in a bath 14 of dilute hydrochloric acid (one volume concentrated 37% by weight HCl, ten volumes of water). The coated graphite functions as the cathode. Another electrode 16, which is also graphite, functions as the anode. The electromotive force from power source 18 is about 12 volts direct current. The anode of this preferred embodiment is graphite because most metals would be anodically corroded into solution.

There are two mechanisms by which the tin oxide is removed from the graphite: (1) The tin oxide is reduced at the cathode to metallic tin while the oxygen forms water with the hydrogen. The metallic tin is subsequently dissolved by the hydrochloric acid.

(2) The graphite may be wetted with the electrolyte through cracks in the tin oxide Then, hydrogen gas forms in the region adjacent to the graphite surface/tin oxide interface, and there is a pressure increase of the hydrogen gas. The increase in pressure tends to force or break away the tin oxide from the surface of the graphite.

Acid electrolytes, such as hydrochloric acid, tend to emphasize dissolution, while neutral salt electrolytes, such as sodium or ammonium salts, favor delamination by gas bubbles In general, conditions which favor hydrogen gas formation at the coater surface will enhance the gas bubble mechanism.

Figure 2:
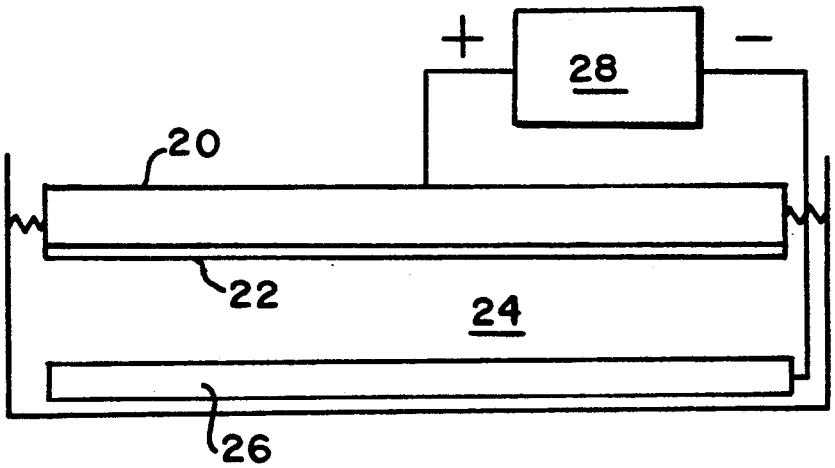
FIG. 2 illustrates an electrolytic cell used for the removal of titanium nitride.

A second embodiment of the invention illustrated in FIG. 2, which shows the bottom surface of a Hastelloy® coater 20 covered with a layer 22 of titanium nitride placed in an electrolyte bath 24. The electrolyte is dilute hydrochloric acid (one volume concentrated hydrochloric, 37% by weight in water, diluted with ten volumes of water). The titanium nitride-coated coater functions as the anode (positive electrode) of the cell. Another electrode 26, made of graphite, serves as the cathode. Any acid-resistant, electrically conducting material can serve as the cathode. About 12 volts direct current is applied to the cell by power source 28, which is a battery charger. Some of the titanium nitride is dissolved, while the rest falls off in flakes dislodged by bubbles of oxygen and chlorine gas formed at the coater surface. Dilute sulfuric acid also functions as an effective electrolyte (one part concentrated sulfuric acid to ten parts of water by volume) An advantage of the sulfuric bath is that it produces no volatile acid fumes (in contrast to the hydrochloric acid fumes), and the anode produces only pure oxygen gas and no chlorine. A disadvantage of the sulfuric acid bath is it is more hazardous to personnel.

Although described in reference to specific process conditions and specific electrodes, those skilled in the art will recognize that other electrolytes and electrodes may be used and are within the scope of the invention.

Having described my invention, what I now claim is:

1. A method for the electrolytic removal of titanium nitride from a coater surface which comprises:

providing an electrolytic cell having an electrolyte and a pair of electrodes, the titanium nitride coated coater surface functioning as the anode and the other electrode functioning as the cathode; and applying a voltage across the electrodes sufficient to remove the titanium nitride from the surface of the coater.

2. The method of claim 1 wherein the electrolyte is an aqueous solution of hydrochloric acid.

3. The method of claim 1 wherein the electrolyte is an aqueous solution of sulfuric acid

4. The method of claims 1, 2 or 3 wherein the anode is a graphite anode.

* * * * *